US007743949B2

(12) United States Patent
Ramet

(10) Patent No.: US 7,743,949 B2
(45) Date of Patent: Jun. 29, 2010

(54) ASSEMBLY FOR PACKAGING AND DISPENSING LIQUID

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 1077 days.

(21) Appl. No.: 11/065,137

(22) Filed: Feb. 24, 2005

(65) Prior Publication Data

US 2005/0211731 A1 Sep. 29, 2005

Related U.S. Application Data

(60) Provisional application No. 60/559,021, filed on Apr. 5, 2004.

(30) Foreign Application Priority Data

Mar. 24, 2004 (FR) ..... 04 03024

(51) Int. Cl.
*B65D 37/00* (2006.01)

(52) U.S. Cl. ..... 222/321.9; 222/385; 141/23

(58) Field of Classification Search ... 222/321.6–321.9, 222/385, 321.5, 340; 141/21–23, 25–29, 141/113, 327, 379–381, 2, 18, 28
See application file for complete search history.

(56) References Cited

U.S. PATENT DOCUMENTS

| | | | | |
|---|---|---|---|---|
| 3,718,165 A | | 2/1973 | Grothoff | |
| 4,167,941 A | * | 9/1979 | Capra et al. | 128/200.23 |
| 4,216,882 A | * | 8/1980 | Basile et al. | 222/207 |
| 4,750,532 A | | 6/1988 | Grothoff | |
| 5,524,680 A | | 6/1996 | De Laforcade | |
| 5,894,958 A | | 4/1999 | De Laforcade | |
| 5,894,960 A | * | 4/1999 | Rodden et al. | 222/207 |
| 6,398,080 B1 | | 6/2002 | De LaForcade | |

FOREIGN PATENT DOCUMENTS

| | | |
|---|---|---|
| DE | 3740823 A1 | 6/1988 |
| FR | 2 430 269 | 2/1980 |
| FR | 2556091 | 6/1985 |
| FR | 2 705 039 | 11/1994 |
| FR | 2773443 | 7/1999 |
| FR | 2802447 | 6/2001 |
| FR | 2813291 | 3/2002 |
| JP | A-2001-158489 | 6/2001 |

* cited by examiner

*Primary Examiner*—J. Casimer Jacyna
(74) *Attorney, Agent, or Firm*—Oliff & Berridge, PLC

(57) ABSTRACT

The present invention relates to an assembly for packaging and dispensing liquid comprising a receptacle for containing a supply of liquid and a refillable unit configured to be disposed in separable manner on the receptacle, comprising a storage chamber for containing the liquid and capable of being put into fluid communication with the receptacle in order to be filled therefrom when the refillable unit is placed on the receptacle and a pump capable of taking liquid from the receptacle when the refillable unit is placed thereon, and of taking liquid from the storage chamber when the refillable unit is separate from the receptacle, the pump having a pump chamber that is distinct from the storage chamber.

47 Claims, 5 Drawing Sheets

ASSEMBLY FOR PACKAGING AND DISPENSING LIQUID

This non provisional application claims the benefit of French Application No. 04 03024 filed on Mar. 24, 2004 and U.S. Provisional Application No. 60/559,021 filed on Apr. 5, 2004.

The present invention relates to an assembly for packaging and dispensing liquid, in particular cosmetics, comprising care products.

In the meaning of the present invention, the term "cosmetic" is used to designate any substance or preparation intended to be placed in contact with the various external parts of the human body (epidermis, hair system, lips and external genital organs) or with the teeth and the mucous membranes of the oral cavity with a view exclusively or mainly to cleaning them, perfuming them, changing their appearance and/or correcting body odours and/or protecting them or keeping them in good condition.

BACKGROUND OF THE INVENTION

Patent application FR 2 773 443 discloses a refillable atomizer spray comprising a body defining a chamber for storing liquid. The atomizer further comprises a piston slidably received in the body and capable of being pressed down in order to reduce the volume of the chamber and dispense the liquid. The quantity of substance that is dispensed depends on the length of the depression stroke of the piston with the chamber being completely emptied when the piston is depressed over its full stroke. That atomizer does not make it easy to dispense an accurate quantity of liquid corresponding to a fraction of the maximum volume of the chamber.

Patent application FR 2 705 039 describes a dispenser device comprising a receptacle containing a supply of liquid and fitted with a first pump, and a refillable flask fitted with a second pump. The flask can be refilled with liquid via the first pump. In order to dispense the liquid contained in the flask, the user separates the flask from the receptacle and then actuates the second pump.

Patent application FR 2 813 291 describes a system for filling a secondary flask from a main flask. The main flask is fitted with tubes enabling the main and secondary flasks to be put into fluid communication. When the secondary flask is fitted with a pump, the pump must be removed before interconnecting the main and secondary flasks for refilling.

Patent application FR 2 802 447 describes a refillable spray system comprising a tank and a spray fitted with a pump. The tank and the spray are provided with ducts suitable for being temporarily interconnected in order to enable the spray to be refilled. The duct extending into the spray is open at its top end to allow the liquid to flow directly into the tank of the spray system.

Patent application FR 2 556 091 describes a removable refillable device comprising a body and a piston slidably received in the body. That device does not have a pump.

OBJECTS AND SUMMARY OF THE INVENTION

The present invention seeks to provide a packaging and dispensing assembly which presents a structure that is relatively simple and enables the liquid to be dispensed in relatively precise manner.

The invention thus provides an assembly for packaging and dispensing liquid, the assembly comprising:

a receptacle for containing a supply of liquid; and a refillable unit configured to be disposed in separable manner on the receptacle, the refillable unit comprising:

a storage chamber for containing the liquid and capable of being put into fluid communication with the receptacle in order to be filled therefrom when the refillable unit is placed on the receptacle; and a pump capable of taking liquid from the receptacle when the refillable unit is placed thereon, and of taking liquid from the storage chamber when the refillable unit is separate from the receptacle, the pump having a pump chamber that is distinct from the storage chamber, i.e. that does not coincide therewith.

By means of the invention, when the refillable unit is used separately from the receptacle, it is possible to dispense one or more measured quantities of liquid relatively accurately, each quantity corresponding to a fraction only of the maximum volume of the storage chamber. The quantity dispensed is determined by the maximum volume of the pump chamber, where the maximum volume of the pump chamber is smaller than the maximum volume of the storage chamber.

The pump can also be used to take liquid from the supply of liquid in the receptacle.

When the receptacle has an outlet orifice suitable for being put into fluid communication with the storage chamber of a refillable unit for refilling purposes, the receptacle need not have a pump capable of feeding said outlet orifice with liquid. The structure of the receptacle can thus be relatively simple.

Thus, the assembly of the invention may comprise only one pump, that of the refillable unit, thus enabling costs to be reduced.

Advantageously, the refillable unit is configured to enable suction to be generated in the storage chamber, at least when the storage chamber is in fluid communication with the receptacle, so as to enable the storage chamber to be filled. Such suction may be generated by means of the pump, or otherwise.

In an embodiment of the invention, the pump chamber is isolated from the storage chamber, at least while the liquid is being dispensed by the pump.

In an embodiment of the invention, the pump has a suction orifice that is suitable for being disposed close to an outlet orifice of the receptacle, e.g. vertically in register with said outlet orifice, when the refillable unit is placed on the receptacle.

Thus, the liquid leaving the receptacle via the outlet orifice can flow towards the suction orifice of the pump following a path that is relatively short, thereby limiting head losses.

In an embodiment of the invention, the pump is an "airless" pump, i.e. a pump without any air intake. The pump may be with or without precompression.

The receptacle may comprise a support configured to receive the refillable unit, said support being held stationary relative to the remainder of the receptacle, for example. The support may be constituted by a separate part or it may be made monolithically with the receptacle.

The refillable unit and the receptacle may comprise respective fastener portions suitable for co-operating in releasable manner, in particular by snap-fastening, screw-fastening or by a bayonet-type fastening, by friction, or in some other way. This makes it possible to secure the refillable unit to the receptacle while the storage chamber is being filled and/or while the pump of the refillable unit is being used to take liquid from the receptacle.

Advantageously, at least one of the receptacle units and the receptacle comprises portions in relief suitable for co-operating with the other one of the refillable unit and the receptacle in order to isolate the suction orifice of the pump in leakproof manner from the outside.

The receptacle may comprise an air intake passage enabling air to be taken in when the pump of the refillable unit is used to take the liquid from the receptacle.

In a variant, the receptacle does not have an air intake, and in particular has a piston or a bag in contact with the liquid. By way of example, the receptacle may have a piston that moves in response to liquid being extracted from the receptacle.

By way of example, the liquid may alternatively be contained in a flexible bag.

In an embodiment of the invention, the storage chamber presents a volume that is substantially constant.

The refillable unit may have a first orifice suitable for being put into fluid communication with the pump and the receptacle in order to enable the pump to take liquid from the receptacle when the refillable unit is placed on the receptacle, and a second orifice distinct from the first, suitable for being put into fluid communication with the receptacle in order to fill the storage chamber.

The second orifice may be made through an end wall of the refillable unit.

The refillable unit may comprise a check valve capable of isolating the suction orifice of the storage chamber while the refillable unit is placed on the receptacle with the receptacle is in the head-up position, and of allowing fluid communication between said suction orifice and the storage chamber when the refillable unit is placed on the receptacle with the assembly being in the head-down position.

The refillable unit may comprise a wall, in particular an end wall, configured to co-operate with a wall of the receptacle when the refillable unit is placed on the receptacle so as to form a passage outside the storage chamber. This passage may serve to put the suction orifice of the pump into fluid communication with the storage chamber. This passage may be closed by the above-mentioned check valve.

The receptacle may comprise a first outlet orifice suitable for being put into fluid communication with the first orifice of the refillable unit when the refillable unit is placed on the receptacle, and a second outlet orifice suitable for being put into fluid communication with the second orifice of the refillable unit when the refillable unit is placed on the receptacle.

The receptacle may comprise a check valve capable of closing the first outlet orifice of the receptacle when the assembly is in the head-down position, and of opening it when the receptacle is in the head-up position.

The refillable unit may comprise a body having the first and second orifices formed therein and a cap configured to be secured in releasable manner on said body when the refillable unit is separate from the receptacle, in order to close said first and second orifices.

The cap may co-operate with the body of the refillable unit when they are assembled together to form a passage outside the storage chamber between the first and second orifices, serving to put the pump into fluid communication with the storage chamber.

The cap may also co-operate with the body of the refillable unit, when they are assembled together, to form an air intake passage enabling air to be taken in when the pump is used to take liquid from the storage chamber.

In another embodiment of the invention, the refillable unit comprises a body and a piston that is movable relative to the body and that co-operates therewith to define a storage chamber of variable volume.

Preferably, when the refillable unit is placed on the receptacle so that the pump can take liquid therefrom, the pump communicating with a dip tube of the receptacle, for example, the volume of the storage chamber is at its minimum, for example being substantially zero.

In an embodiment of the invention, the storage chamber is formed under the piston, when the refillable unit is observed in the head-up position.

The refillable unit may comprise a moving assembly that is movable relative to said body, the moving assembly comprising the piston.

Advantageously, the moving assembly comprises an outer sheath slidable on the body.

The moving assembly may also comprise a pump, which may have a duct, the piston being secured around said duct. Advantageously, the piston presents a bottom face that is set back from the bottom face of the duct, which duct comprises a portion extending it downwards beneath the piston.

Thus, when the suction orifice of the pump is formed at the bottom end of the above-mentioned duct portion, the suction orifice is situated at a certain distance from the bottom face of the piston, thus enabling it to dip into the liquid contained in the storage chamber, even in the presence of a layer of air in the top portion of the storage chamber.

The body of the refillable unit may comprise an orifice enabling the storage chamber to be put into fluid communication with the receptacle.

The refillable unit may comprise a cap suitable for being secured on the body in releasable manner, in particular by screw-fastening or snap-fastening, so as to close said orifice when the refillable unit is separated from the receptacle.

The receptacle may contain a cosmetic or a care product, and in particular it may contain a perfume. The liquid could also be a cream, for example.

The invention also provides a refillable unit configured to be disposed in separable manner on a receptacle, the refillable unit comprising:

- a storage chamber for containing liquid and capable of being put into fluid communication with the receptacle in order to be filled therefrom when the refillable unit is placed on the receptacle; and
- a pump capable of taking liquid from the receptacle when the refillable unit is placed on the receptacle, and of taking liquid from the storage chamber when the refillable unit is separate from the receptacle, the pump having a pump chamber that is distinct from the storage chamber.

The refillable unit may be configured so as to enable suction to be generated in the storage chamber, at least when the storage chamber is in fluid communication with the receptacle, so as to enable the storage chamber to be filled under the effect of the suction created in this way.

The volume of the pump chamber is preferably smaller than the maximum volume of the storage chamber.

In an embodiment of the invention, the storage chamber presents a volume that is substantially constant.

The refillable unit may comprise a first orifice suitable for being put into fluid communication with the pump and the receptacle in order to enable the pump to take liquid from the receptacle when the refillable unit is placed on the receptacle, and a second orifice distinct from the first that is suitable for being put into fluid communication with the receptacle in order to fill the storage chamber.

In a variant, the refillable unit comprises a body and a piston that is movable relative to the body and that co-operates therewith to define a storage chamber of variable volume.

In an embodiment of the invention, the storage chamber is situated under the piston when the refillable unit is observed in the head-up position.

The pump may comprise a duct, the piston being secured around said duct. The piston advantageously presents a bottom face that is set back from the bottom end of the duct, which duct has a portion extending it downwards beneath the piston.

In another of its aspects, the invention also provides a method of dispensing liquid, the method comprising the following steps:

providing a packaging and dispenser assembly, comprising:

a receptacle for containing a supply of liquid; and a refillable unit configured to be placed in separable manner on the receptacle and comprising a storage chamber and a pump;

using the refillable unit to take liquid either from the receptacle when the refillable unit is placed on the receptacle, or from the storage chamber of the refillable unit when the refillable unit is separate from the receptacle; and dispensing a quantity of liquid taken by means of the refillable unit by actuating the pump over a full stroke, the quantity of liquid dispensed corresponding to a fraction only of the maximum volume of the storage chamber, and in particular to less than one-tenth thereof.

For a pump having a suction orifice and a receptacle having an outlet orifice, the method may comprise the following steps:

putting the suction orifice into communication with the outlet orifice; and taking liquid from the receptacle.

The method may comprise the following steps:

placing the refillable unit on the receptacle, the assembly being in the head-down position; and actuating the pump several times over a full stroke in order to establish suction in the storage chamber and allow it to be filled with liquid without any liquid being dispensed between two full strokes.

In a variant, for a refillable unit comprising a body and a piston slidable in the body, the method comprises the following steps:

placing the refillable unit on the receptacle; and moving the piston relative to the body in order to increase the volume of the storage chamber, the piston being stationary relative to the pump during this movement.

BRIEF DESCRIPTION OF THE DRAWINGS

The present invention can be better understood on reading the following detailed description of non-limiting embodiments thereof, and on examining the accompanying drawings, in which.

MORE DETAILED DESCRIPTION

Figure 1:
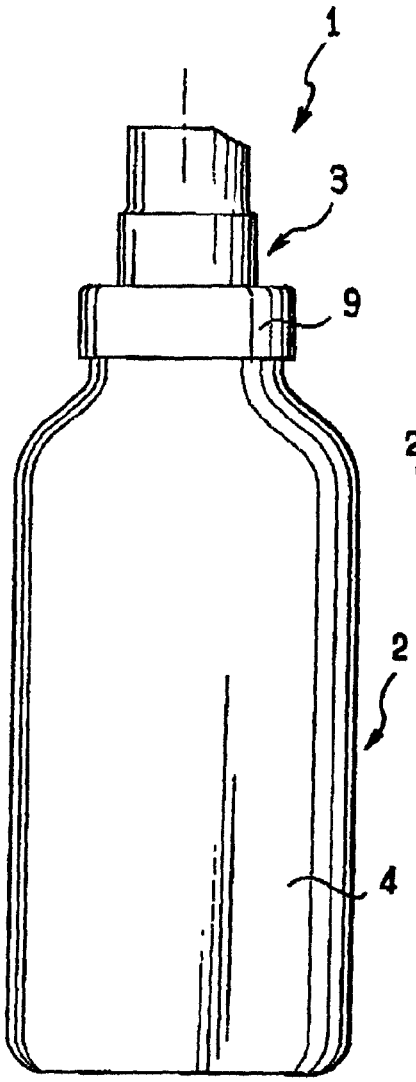
FIG. 1 is a diagrammatic and fragmentary view of a packaging and dispenser assembly in accordance with the invention.

FIG. 1 shows a packaging and dispenser assembly 1 in accordance with the invention comprising a receptacle 2 for containing a supply of liquid and a refillable unit 3 configured to be disposed in releasable manner on the receptacle 2.

In the example described, the liquid is a cosmetic, in particular a perfume or some other low-viscosity liquid, e.g. containing an alcohol-based solvent. In a variant, the liquid may be a cream, for example a care product, a lotion, or some other liquid for applying to a portion of the body or the face, comprising the hair.

The receptacle 2 comprises a receptacle body 4 provided at its top end with a neck 6. The neck has a bead 7 for securing a support 9 that is to receive the refillable unit 3.

Figure 2:
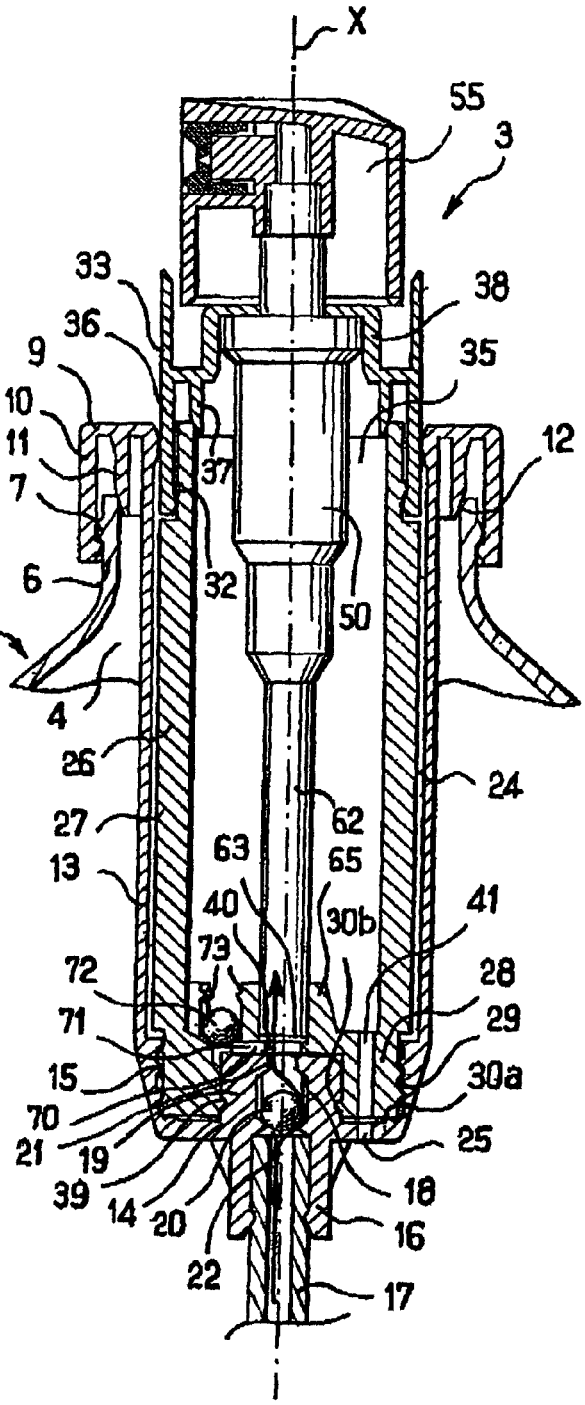
FIG. 2 is a diagrammatic and fragmentary axial section view of the FIG. 1 assembly.

The support 9 may be made as a single piece, and as shown in FIG. 2, it can comprise an assembly skirt 10 for co-operating with the bead 7 on the neck 6. In the example described, the assembly skirt 10 is snap-fastened on the neck 6, however in a variant it could be secured in some other way, in particular by screw-fastening or by crimping.

Where appropriate, at least one of the neck 6 and the support 9 may comprise antirotation means, e.g. a portion in relief (not shown) preventing the support 9 from turning relative to the receptacle 2.

The support 9 is provided with a sealing lip 11 that presses against the inside surface of the neck 6 in order to prevent liquid escaping, while also leaving an air intake passage 12 between the inside of the receptacle 2 and the outside.

The support 9 further comprises a substantially cylindrical wall 13 about an axis X. This wall 13 extends over substantially the entire height of the support 9 inside the body 4 and is connected at the bottom end to a bottom wall 14 via an internally threaded portion 15.

The wall 13 presents a cross-section that may be circular, elliptical, or of some other shape.

The walls 13 and 14 together define a housing 24 inside the support 9 for receiving the refillable unit 3.

The bottom wall 14 carries an endpiece 16 on its bottom face for securing a dip tube 17, and on its top face it carries a portion 19 for leaktight coupling with the refillable unit 3.

This coupling portion 19 defines a housing 18 in communication firstly downwards with the dip tube 17 via an opening 22, and secondly upwards with the outside of the receptacle 2 via a first outlet orifice 21.

Figure 4:
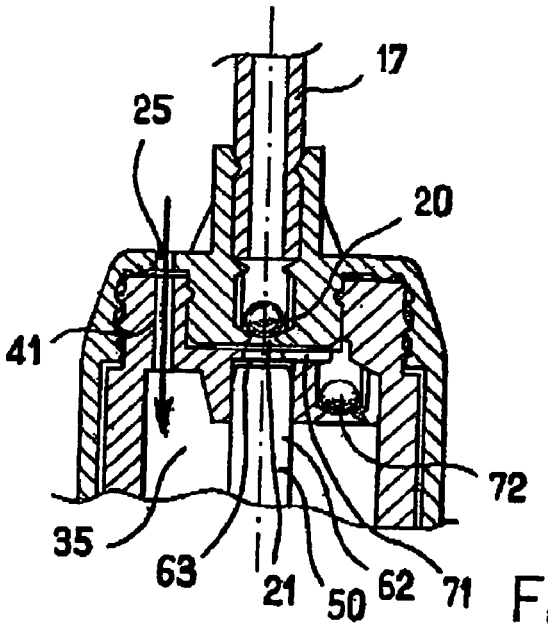
FIG. 4 is a diagrammatic and fragmentary axial section view of the FIG. 2 assembly while the refillable unit is being filled.

The housing 18 receives a ball 20 suitable for forming a check valve capable of closing the first outlet orifice 21 when the receptacle 2 is head-down, as shown in FIG. 4. The check valve could present any other suitable form, without that going beyond the ambit of the present invention.

While the refillable unit 3 is being withdrawn, the check valve can serve to isolate the dip tube 17 from the outside, so that the liquid contained in the dip tube 17 can remain therein.

The bottom wall 14 has a second outlet orifice 25 located radially outside the coupling portion 19 for performing a function that is explained below.

The refillable unit 3 comprises a body 26 provided with a substantially cylindrical wall 27 about the axis X, and that is connected to a bottom wall 28. The wall 27 has a cross-section that may be circular, elliptical, or of some other shape.

The bottom portion of the body 26 presents a thread 29 for engaging in the threaded portion 15 of the support 9 when the refillable unit 3 is engaged in the housing 24 in leaktight manner.

On the outside, the bottom wall 28 presents a setback 39 into which a first orifice 40 opens out substantially in register with the first outlet orifice 21 of the receptacle 2, when the refillable unit 3 is in place in the housing 24. The bottom wall 28 also comprises a second orifice 41 that is located eccentrically relative to the axis X, and that comes substantially into register with the second outlet orifice 25 of the receptacle.

The body 26 of the refillable unit 3 comprises at least one portion in relief 30*a* in its bottom portion, e.g. an annular bead, suitable for bearing in leaktight manner against the support 9. Another portion in relief 30*b*, such as an annular bead, for example, is made on the body 26 to press in substantially leaktight manner against the coupling portion 19. The orifices 21 and 40 are isolated from the outside by the portions in relief 30*a* and 30*b*.

At its top end, the body 26 has an annular bead 32 enabling an insert 33 to be secured that co-operates with the body 26 to define a storage chamber 35 of substantially constant volume.

The insert 33 has an assembly skirt 36 co-operating with the bead 32 by snap-fastening. In a variant, the insert 33 could be secured to the body 26 by screw-fastening or by crimping.

The insert 33 also has a sealing lip 37 pressing against the inside surface of the body 26, and a neck 38 for holding a pump 50, which pump in the example described in a conventional airless pump.

Figure 3:
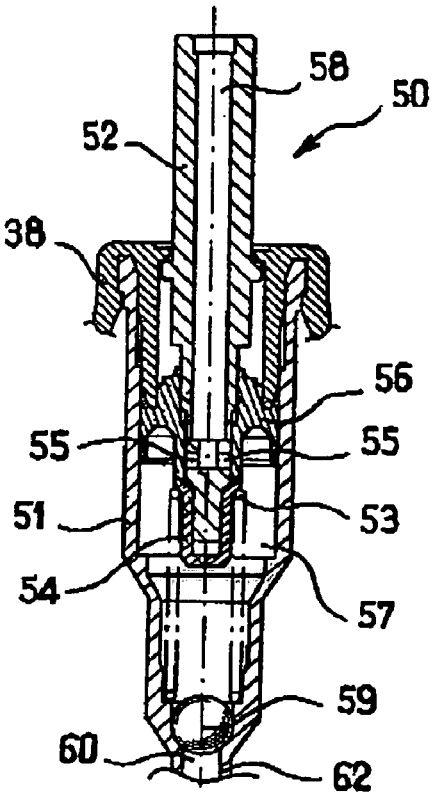
FIG. 3 is a diagrammatic and fragmentary axial section view of the pump of the refillable unit of the assembly of FIGS. 1 and 2.

As shown in FIG. 3, the pump 50 may comprise a body 51 secured to the neck 38, e.g. by snap-fastening.

A control rod 52 is mounted in the body 51 to slide against the action of a return spring 53 working in compression. An endpiece 54 is secured to the bottom end of the control rod 52.

A pushbutton 55 that serves both as an actuator member and as a dispenser member is engaged as a force-fit on the top end of the control rod 52, as can be seen in FIG. 2.

The control rod 52 has an axial bore 58 extending to its top end and opening out into the pump chamber 57 via radial orifices 55.

A piston 56 is disposed to slide around the rod 52, the piston 56 co-operating with the body 51 to define a pump chamber 57.

The body 51 forms a seat for a ball 59 that, at rest, closes an orifice 60.

When the control rod 52 is at rest, the orifices 55 are closed by the piston 56.

When the user presses on the pushbutton 55, the control rod 52 is depressed into the body 51. At the beginning of its depression stroke, the piston 56 is not driven by the control rod 52. The control rod thus moves relative to the piston 56, thereby releasing the orifices 55. As the depression stroke of the control rod 52 continues, it entrains the piston 56 downwards. The liquid in the pump chamber 57 is then compressed and flows into the bore 58 via the orifices 55 in order to be dispensed.

While the control rod 52 is moving downwards, the ball 59 remains pressed against its seat in the bottom of the body 51, thereby isolating the pump chamber 57 from the storage chamber 35.

When the user releases the pushbutton 55, the control rod 52 begins by sliding in the piston 56 until it comes into top abutment against the endpiece 54.

The axial bore 58 is then isolated from the pump chamber 57 and continued upward movement of the control rod 52 under drive from the spring 53 generates suction in the pump chamber 57, which is accompanied by the ball 59 lifting and liquid being sucked into the pump chamber 57.

In the example described, the pump 50 has a duct 62 extending to the bottom wall 28 of the body 26, this duct 62 presenting a suction orifice 63 that opens out at a very short distance from the first orifice 40.

The duct 62 has its bottom end held by an endpiece 65 connected to the bottom wall 28.

Naturally, the pump 50 could present some other structure without thereby going beyond the ambit of the present invention, and in particular the ball 59 could be replaced by a suction check valve made of elastomer, for example.

In its outside face, the bottom wall 28 of the refillable unit 3 presents a groove 70 extending radially and co-operating with the coupling portion 19 of the support 9 to define a passage 71 outside the storage chamber 35. This passage 71 enables fluid communication to be established between the suction orifice 63 of the pump 50 and the storage chamber 35 while the refillable unit 3 is in place on the receptacle 2.

Inside the storage chamber 35, the bottom wall 28 is connected to tabs 73 defining a housing for a ball 72 capable of closing the passage 71 when the refillable unit 3 is placed on the receptacle 2, the receptacle being in a head-up position.

The assembly 1 can be used in various ways.

Firstly, the assembly 1 can be used in a bathroom, e.g. for the purpose of taking and dispensing the liquid contained in the receptacle 2.

For this purpose, the user secures the refillable unit 3 in the housing 24 of the receptacle 2.

The thread 29 of the refillable unit 3 is engaged in the threaded portion 15 of the support 9, and the portions in relief 30*a* and 30*b* enable the orifices 21, 40, 25, and 42 to be isolated in leaktight manner from the outside.

The assembly 1 is placed head-up as shown in FIG. 2, so that the ball 72 closes the passage 71. Thus, the suction orifice 63 of the pump 50 is not in communication with the storage chamber 35.

The user actuates the pump 50 by depressing the pushbutton 55, thereby causing the liquid present in the pump chamber 57 to be dispensed.

When the pushbutton 5 is released, suction is established in the pump chamber 57 of the pump 50, thus causing liquid coming from the receptacle 2 to be sucked in through the suction orifice 63, which liquid flows along a path comprising the dip tube 17, the housing 18, and the orifices 21 and 40, with the ball 20 lifting to allow the liquid to flow.

Because of the ball 72, the suction orifice 63 does not communicate with the storage chamber 35, but only with the supply of liquid in the receptacle 2.

In addition, the portions in relief 30*a* and 30*b* isolate the suction orifice 63 from the outside, thereby preventing the pump becoming unprimed.

While the pump is in action, air can be taken into the receptacle 2 via the passage 12.

After being refilled, the refillable unit 3 can also be used separately from the receptacle 2, for example it can be carried about in a handbag.

Figure 5:
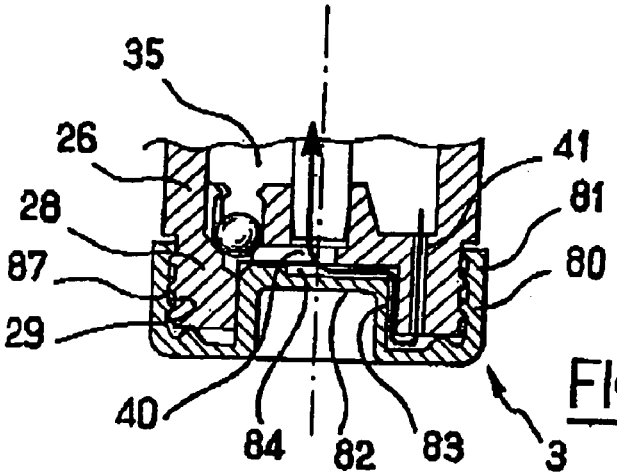
FIG. 5 is a diagrammatic and fragmentary axial section view of the refillable unit separated from the receptacle.

For this purpose, the user separates the refillable unit 3 from the receptacle 2 and secures a cap 80 on the bottom wall 28 of the refillable unit 3, as shown in FIG. 5.

On separation of the refillable unit 3 from the receptacle 2, it should be observed that no liquid escapes from the chamber 35 via the orifices 40 and 41 prior to the cap 80 being put into place because of the surface tension of the liquid, given that the refillable unit does not have any open orifice other than the orifices referenced 40 and 41.

The cap 80 comprises an assembly skirt 81 enabling it to be screwed onto the thread 19 of the body 26, and a projecting portion 82 that engages in the setback 39 of the body 26.

The cap 80 also has a groove 83 co-operating with the bottom wall 28 of the body 26 to define a passage 84 outside the storage chamber 35, enabling the second orifice 41 to be put into communication with the first orifice 40.

An air intake passage 87 for the storage chamber 35 is also defined between the cap 80 and the body 26.

In order to dispense the liquid contained in the storage chamber 35, the user places the refillable unit in a head-up position and actuates the pump 50, thereby enabling the liquid contained in the storage chamber 35 to be sucked in through the suction orifice 63, which liquid then flows along a path passing via the orifice 41, the passage 83, and the orifice 40.

When the user releases the pushbutton 55, air can penetrate into the storage chamber 35 via the air intake passage 87.

When the refillable unit 3 is separate from the receptacle 2, it is possible to provide a cap (not shown) for closing the outlet orifices 21 and 25 of the receptacle 2. By way of example, the cap can be configured to fit also over the pushbutton 55.

It should be observed that it is possible to secure the refillable unit 3 on the receptacle 2, even when the storage chamber 35 is not completely empty.

In order to refill the storage chamber 35, the assembly 1 is put in a head-down position, as shown in FIG. 4.

In this position, the ball 72 releases the passage 71, and the suction orifice 63 of the pump 50 can communicate with the storage chamber 35, while the ball 20 closes the orifice 21 so as to isolate the suction orifice 63 of the pump 50 from the dip tube 17.

The user actuates the pump 50, thereby evacuating the air from the storage chamber 35 so as to establish suction therein. This suction causes liquid to flow from the receptacle 2 into the storage chamber 35 through the orifices 25 and 41.

The user can be informed that the storage chamber 35 has been completely filled by any further actuation of the pump 50 causing liquid to be dispensed.

It would not go beyond the ambit of the present invention for the storage chamber of the refillable unit to present a volume that is variable.

Figure 6:
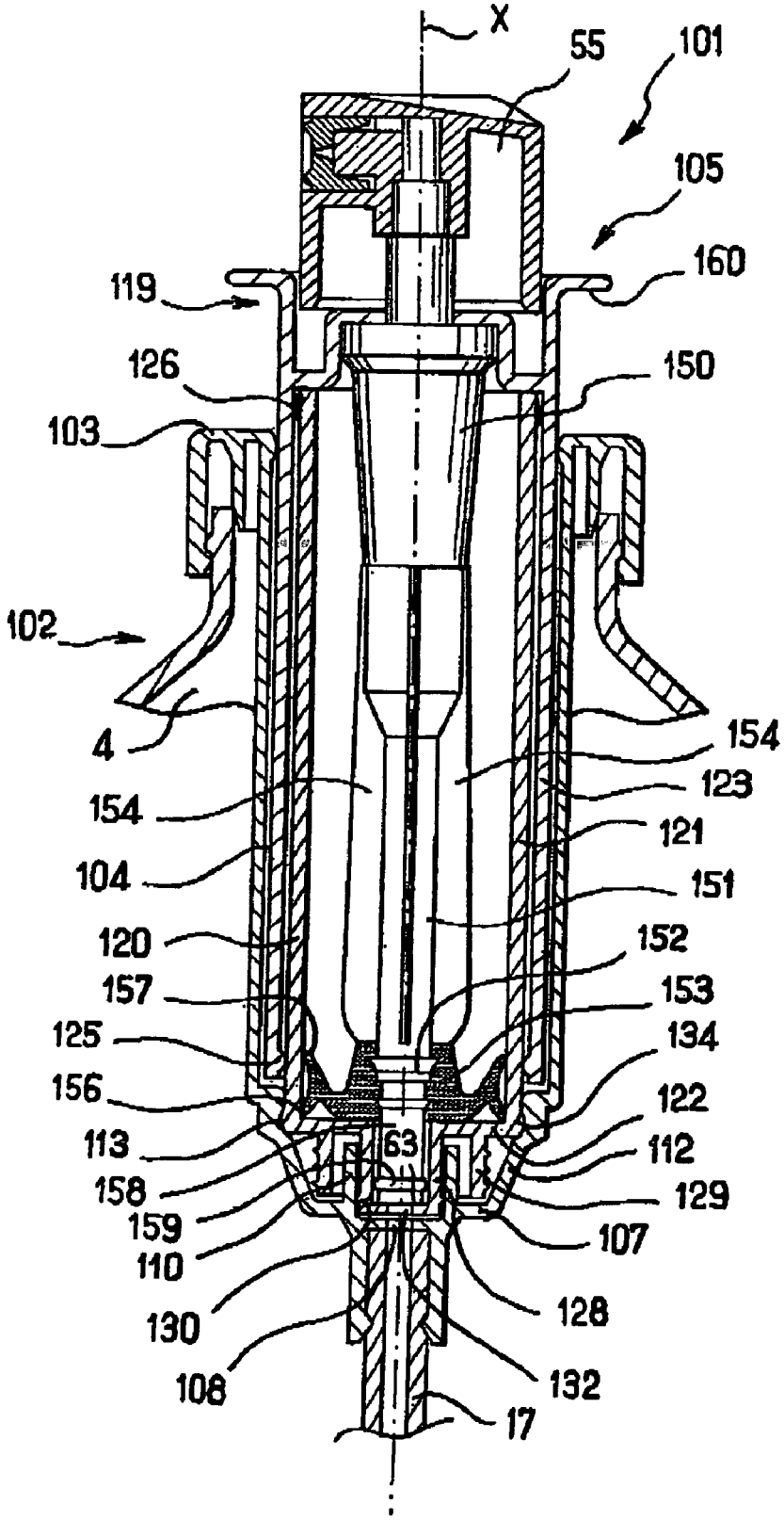
FIG. 6 is a diagrammatic and fragmentary axial section view of a packaging and dispenser assembly constituting another embodiment of the invention.
Figure 7:
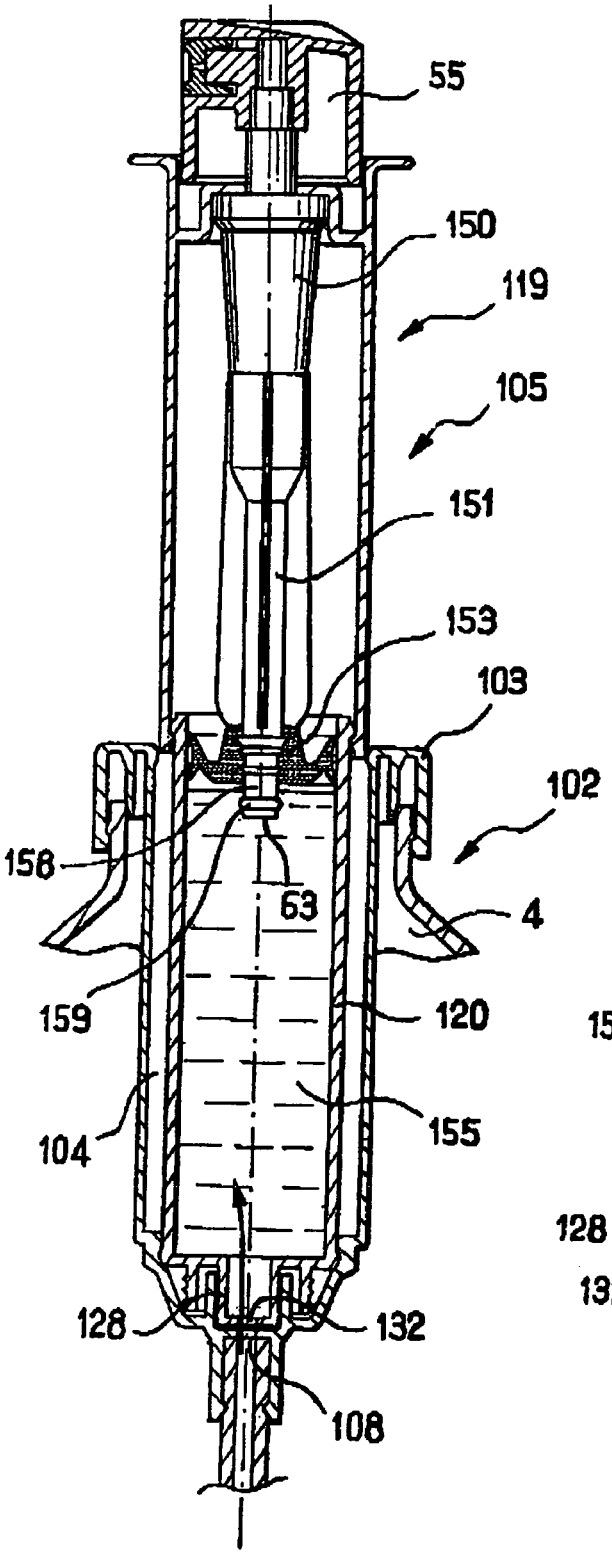
FIG. 7 is a diagrammatic and fragmentary view of the FIG. 6 assembly at the end of filling.
Figure 8:
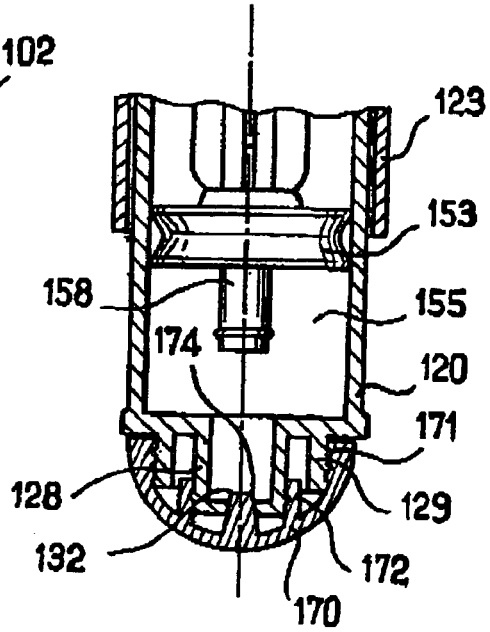
FIG. 8 is a diagrammatic and fragmentary axial section view of the refillable unit of the assembly of FIGS. 6 and 7 when separated from the receptacle.

There follows a description with reference to FIGS. 6 to 8 of a packaging and dispenser assembly 101 presenting such a characteristic.

The assembly 101 comprises a receptacle 102 containing a supply of liquid, in particular a cream. The receptacle 102 comprises a body 4 and a support 103 secured to the body 4 and co-operating therewith like the above-described support 9 to define a housing 104 for receiving a refillable unit 105.

The support 103 differs from the support 9 by the fact that it has a bottom wall 107 pierced by a single outlet orifice 108, at which the dip tube 17 opens out directly, without an intervening check valve.

The bottom wall 107 is connected via its top face to a substantially cylindrical wall 110, into which the outlet orifice 108 opens out.

In its bottom portion, the support 103 has an intermediate part 112 connected to the bottom wall 107, said intermediate part 112 having an inside groove 113.

The refillable unit 105 comprises a body 120 presenting a substantially cylindrical wall 121 of longitudinal axis X, and a bottom wall 122. The wall 121 presents a cross-section that may be circular or of some other shape.

A moving assembly 119 is movable relative to the body 120, and comprises an outer sheath 123. At its bottom end and on its inside surface, the sheath has first portions in relief 125 suitable for co-operating with second portions in relief 126 made at the top end of the body 120 so as to form an abutment limiting the up stroke of the sheath 123 relative to the body 120.

At its bottom end, the body has an endpiece 128 that connects to the bottom wall 122, and around said endpiece 128, it has an assembly skirt 129 with an outside thread that performs a function explained below.

The endpiece 128 has an annular sealing bead 130 suitable for pressing in leaktight manner against the wall 110 of the receptacle 102.

The endpiece 128 is provided with an orifice 132 that comes into position in register with the outlet orifice 108 of the receptacle 2 at a distance therefrom that is small or substantially zero, when the refillable unit 105 is in place on the receptacle 102, as shown in FIG. 6.

At the bottom end of the tubular wall 121, the body 120 of the refillable unit 105 has an annular bead 134 suitable for snap-fastening in the groove 113 of the support 103 in order to hold the body 120 to the support 103, as explained below.

The moving assembly 119 has an airless pump 150 provided on the inside with a pump chamber.

The pump 150 comprises a duct 151 provided with fastening portions in relief 152 enabling a piston 153 to be fastened around the duct 151. The bottom face of the piston 153 is set back from the bottom end of the duct 151, the duct having a portion 158 that extends it downwards beneath the piston 153, to perform a function that is described in greater detail below.

The piston 153 has two annular lips, a bottom lip 156 and a top lip 157 that press against the inside surface of the body 120, and it co-operates with the body 120 to define a storage chamber 155 of variable volume beneath the piston 153, as can be seen in FIGS. 7 and 8.

Over a major fraction of its height, the duct 151 further comprises longitudinal stiffening splines 154 that can act as an abutment for the top face of the piston 153.

The portion of the duct 158 that extends beneath the piston 153 has an annular bead 159 suitable for bearing in leaktight manner against the inside surface of the endpiece 132.

At its top end, the sheath 123 is provided with a finger-engaging collar 160.

In order to take liquid from the receptacle 102 and dispense it, the user inserts the refillable unit 105 into the housing 104 of the support 103, and pushes the moving assembly 119 down to its end-of-stroke position, with the suction orifice 63 of the pump 150 then being in register with the orifices 108 and 132, and at a distance that is substantially zero from the orifice 132. The annular bead 134 is then engaged in the groove 113 of the support 103. In this position, the orifices 108 and 132 are isolated from the outside.

Thus, liquid can flow from the dip tube 17 towards the suction orifice 63 with little head loss.

When the refillable unit 105 is placed on the receptacle 102 with the storage chamber 155 still partially full of liquid, the moving assembly 119 is not pushed down all the way to the end-of-stroke position in the body 120.

In order to connect the duct 151 to the outlet orifice 108, the user must push the moving assembly 119 down to its end-of-stroke position, thereby causing the liquid that was contained in the storage chamber 155 to be expelled into the receptacle 102 through the orifices 132 and 108 and the dip tube 17. During this stage, the bead 130 is pressed in leaktight manner against the wall 110 of the receptacle 2, and the bead 134 is not yet engaged in the groove 113. At the end of the stroke of the moving assembly 119, the duct portion 158 engages in the endpiece 128, with the volume of the storage chamber 155 then being at its minimum, for example then being substantially zero. The unit is finally put into place by the bead 134 engaging in the groove 113. This engagement is felt by the user, thus informing the user that the unit is properly in place.

Once the duct 151 is connected to the outlet orifice 108, the user can take liquid directly from the receptacle 102, preferably in the head-up position, by actuating the pump 150.

When the user presses the pushbutton 55, liquid is sucked by the pump 150 to follow a path passing via the dip tube 17 and the orifices 108 and 132.

In order to fill the storage chamber 155 to enable the refillable unit to be used on its own, the user causes the moving assembly 119 to slide upwards relative to the body 120, holding down the receptacle 2 and pulling on the collar 160 with the fingers.

The co-operation between the annular bead 134 and the groove 113 ensures that the body 120 remains held on the support 103 against a predefined separation force, greater than that exerted on the body 120 when the user is causing the moving assembly 119 to slide upwards. Thus, the body 120 remains secured to the support 103 while the moving assembly 119 is being moved upwards.

During this operation, the volume of the storage chamber 155 increases, thereby establishing suction therein for sucking in the liquid contained in the receptacle 2, with the liquid following a path passing via the dip tube 17 and the orifices 108 and 132.

Once the refillable unit 105 has been filled, the user can separate it from the support 103 of the receptacle 102 by exerting sufficient force on the body 120 to disengage the annular bead 134 from the groove 113.

The liquid contained in the storage chamber 155 does not leak out from the orifice 132, given the surface tension of the liquid.

Once the refillable unit 105 has been separated from the receptacle 102, the user puts a cap 170 onto the body 120. The cap 170 has a thread 171 for co-operating with the assembly skirt 129 of the body 120, a sealing lip 172, and a central peg 174 for engaging in the orifice 132 of the body 120.

In a variant, the cap could have some other form.

In order to dispense the liquid contained in the storage chamber 155, the user actuates the pump 150.

Because of the presence of the duct portion 158 extending under the piston 153, the pump 150 does not become unprimed even if a layer of air should accumulate under the piston 153, since the suction orifice 63 can remain immersed in the liquid.

Since the pump 150 is an airless pump, the body 120 moves relative to the piston 153 as liquid is dispensed, as shown in FIG. 8.

Naturally, the invention is not limited to the embodiment described above.

Figure 9:
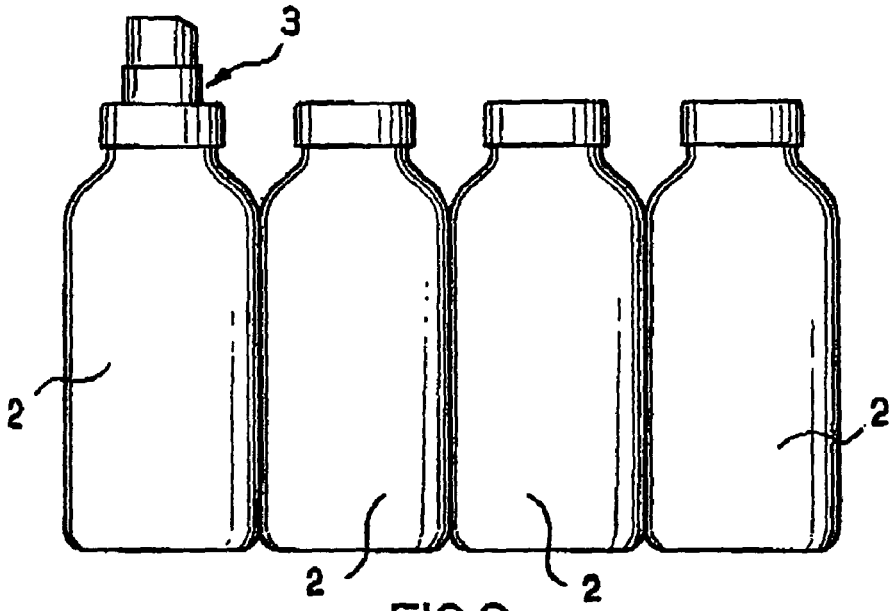
FIG. 9 is a diagrammatic and fragmentary view of a packaging and dispenser assembly constituting another embodiment of the invention.

It is possible to use a refillable unit, e.g. the above-described refillable unit 3, not only with a single receptacle 2, but with a plurality of receptacles 2 as shown in FIG. 9.

The refillable unit 3 can be placed temporarily on any one of the receptacles 2 in order to enable a certain amount of liquid to be transferred from the receptacle 2 into the storage chamber of the refillable unit.

Thus, for example, each of the receptacles 2 may contain respective liquids corresponding to particular respective fragrances, and the user can select one of the receptacles depending on the fragrance desired for that day.

The user may also make up a mixture of liquids taken successively from a plurality of receptacles 2.

The receptacles 2 can be sold separately from the refillable unit 3.

Figure 10:
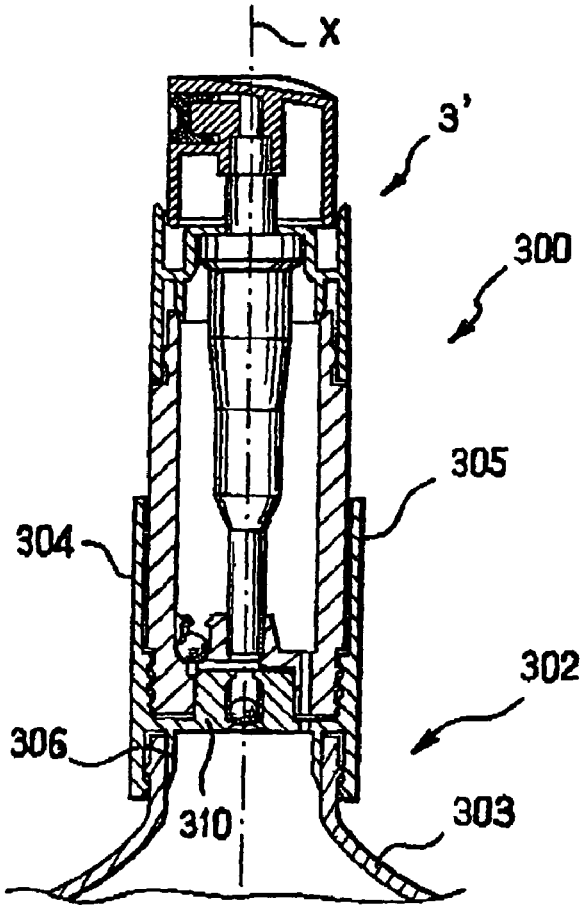
FIG. 10 is a diagrammatic and fragmentary axial section view of a packaging and dispenser assembly constituting another embodiment of the invention.

FIG. 10 shows a packaging and dispenser assembly 300 constituting another embodiment of the invention.

This assembly 300 comprises a refillable unit 3' that is substantially analogous to the unit described above.

The refillable unit 3' may be shorter and of larger cross-section than the refillable unit 3.

The refillable unit 3' may be refilled using a receptacle 302 comprising a receptacle body 303 with a neck 306 having a support 304 secured thereto, e.g. by snap-fastening.

By way of example, the support 304 comprises a tubular skirt 305 of axis X extending above the neck 306 of the receptacle body 303 in order to receive the refillable unit 3'.

In the example described, the support 304 comprises a bottom wall 310 substantially analogous to the bottom wall 14 described above, except that the wall 310 does not have an endpiece for securing a dip tube.

The receptacle 302 can be of the airless type, having a piston or a bag (not shown) in contact with the liquid and suitable for following the reduction in the volume of the supply of liquid contained in the receptacle 2, on each occasion that liquid is taken by the refillable unit.

Throughout the description, comprising in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An assembly for packaging and dispensing liquid, the assembly comprising:

a receptacle for containing a supply of liquid; and a refillable unit having a longitudinal axis and configured to be disposed in a separable manner on the receptacle, the refillable unit comprising:

a storage chamber for containing the liquid and capable of being put into fluid communication with the receptacle in order to be filled therefrom when the refillable unit is placed on the receptacle; and a pump having a pump chamber that is distinct from the storage chamber and being configured for taking liquid from the receptacle without taking liquid from the storage chamber when the refillable unit is placed thereon, and for taking liquid from the storage chamber when the refillable unit is separate from the receptacle, the refillable unit comprising a body and a piston that is movable relative to the body along the longitudinal axis of the refillable unit and the receptacle, the piston being of annular shape and extending all around a part of the pump.

2. An assembly according to claim 1, wherein the refillable unit is configured to enable suction to be generated in the storage chamber, at least when the storage chamber is in fluid communication with the receptacle, so as to enable the storage chamber to be filled.

3. An assembly according to claim 1, wherein the receptacle includes an outlet orifice suitable for being pushed into fluid communication with the storage chamber of the refillable unit for filling purposes, and wherein the receptacle does not include a pump arranged to feed said outlet orifice with liquid.

4. An assembly according to claim 1, wherein the pump chamber is isolated from the storage chamber, at least while the pump is dispensing liquid.

5. An assembly according to claim 1, wherein a volume of the pump chamber is smaller than a maximum volume of the storage chamber.

6. An assembly according to claim 1, the pump comprising a suction orifice, wherein, when the refillable unit is placed on the receptacle, said suction orifice of the pump is suitable for being placed close to an outlet orifice of the receptacle, vertically in registration with said outlet orifice.

7. An assembly according to claim 1, wherein the pump comprises an airless pump.

8. An assembly according to claim 1, wherein the receptacle comprises a support configured to receive the refillable unit, said support being stationary relative to a remainder of the receptacle.

9. An assembly according to claim 1, wherein the refillable unit and the receptacle have respective fastener portions suitable for co-operating in a releasable manner.

10. An assembly according to claim 1, wherein at least one of the refillable unit and the receptacle comprises portions in relief suitable for co-operating with the other one of the refillable unit and the receptacle to isolate the suction orifice of the pump in a leaktight manner from the outside.

11. An assembly according to claim 1, wherein the receptacle comprises an air intake passage.

12. An assembly according to claim 1, wherein the receptacle does not include an air intake.

13. An assembly according to claim 1, wherein the storage chamber has a volume that is substantially constant.

14. An assembly according to claim 13, wherein the refillable unit includes a first orifice suitable for being put into fluid communication with the pump and the receptacle to enable the pump to take liquid from the receptacle when the refillable unit is placed on the receptacle, and a second orifice distinct from the first orifice, suitable for being put into fluid communication with the receptacle to fill the storage chamber.

15. An assembly according to claim 14, wherein the second orifice is made in a bottom wall of the refillable unit.

16. An assembly according to claim 13, wherein the pump comprises a suction orifice, wherein the refillable unit comprises a check valve suitable for isolating the suction orifice of the storage chamber when the refillable unit is placed on the receptacle, the receptacle being in a head-up position, and allowing fluid communication between said suction orifice and the storage chamber when the refillable unit is placed on the receptacle, with the receptacle in a head-down position.

17. An assembly according to claim 16, wherein the refillable unit includes a wall configured to co-operate with a wall of the receptacle when the refillable unit is placed on the receptacle, to form a passage outside the storage chamber arranged to put the suction orifice of the pump into fluid communication with the storage chamber, said passage being closable by said check valve.

18. An assembly according to claim 14, wherein the receptacle includes a first outlet orifice suitable for being put into fluid communication with the first orifice of the refillable unit when the refillable unit is placed on the receptacle, and a second outlet orifice suitable for being put into fluid communication with the second orifice of the refillable unit when the refillable unit is placed on the receptacle.

19. An assembly according to claim 18, wherein the receptacle comprises a check valve arranged to close said first outlet orifice of the receptacle when the receptacle is in a head-down position, and to release said orifice when the receptacle is in a head-up position.

20. An assembly according to claim 14, wherein the refillable unit includes a body having the first and second orifices formed therein, and a cap configured to be releasably secured on said body when the refillable unit is separate from the receptacle, in order to close said first and second orifices.

21. An assembly according to claim 20, wherein the cap co-operates with the said body, when the cap and the body are assembled together, to form a passage outside the storage chamber between the first and second orifices, enabling the pump to be put into fluid communication with the storage chamber.

22. An assembly according to claim 20, wherein the cap co-operates with said body, when the cap and the body are assembled together, to define an air intake passage.

23. An assembly according to claim 1, wherein the piston co-operates with the body to define a storage chamber of variable volume.

24. An assembly according to claim 23, wherein, when the refillable unit is placed on the receptacle so that the pump can take liquid from the receptacle, the volume of the storage chamber is at a minimum.

25. An assembly according to claim 23, wherein the storage chamber is formed under the piston when the refillable unit is observed in a head-up position.

26. An assembly according to claim 25, wherein the refillable unit comprises a moving assembly that is movable relative to the body, the moving assembly comprising the piston.

27. An assembly according to claim 26, wherein the moving assembly comprises an outer sheath slidable on the body.

28. An assembly according to claim 26, wherein the moving assembly comprises a pump.

29. An assembly for packaging and dispensing liquid, the assembly comprising:

a receptacle for containing a supply of liquid; and a refillable unit configured to be disposed in a separable manner on the receptacle, the refillable unit comprising:

a storage chamber for containing the liquid and capable of being put into fluid communication with the receptacle in order to be filled therefrom when the refillable unit is placed on the receptacle; and a pump having a pump chamber that is distinct from the storage chamber and being configured for taking liquid from the receptacle when the refillable unit is placed thereon, and for taking liquid from the storage chamber when the refillable unit is separate from the receptacle, wherein the refillable unit comprises a body and a piston that is movable relative to the body and that co-operates therewith to define a storage chamber of variable volume, the storage chamber being formed under the piston when the refillable unit is observed in the head-up position, the refillable unit comprising a moving assembly that is movable relative to the body, the moving assembly comprising the piston and a pump comprising a duct, with the piston being secured around said duct.

30. An assembly according to claim 29, wherein the piston includes a bottom face that is set back from a bottom end of the duct, which duct has a portion extending it downwards beneath the piston.

31. An assembly according to claim 25, wherein the body of the refillable unit includes an orifice enabling the storage chamber to be put into fluid communication with the receptacle.

32. An assembly according to claim 31, wherein the refillable unit comprises a cap suitable for being fastened in a releasable manner to the body so as to close said orifice when the refillable unit is separate from the receptacle.

33. An assembly according to claim 1, wherein the receptacle contains a cosmetic, comprising a care product.

34. An assembly according to claim 33, wherein the liquid comprises a cream.

35. An assembly according to claim 9, wherein the refillable unit and the receptacle include respective fastener portions suitable for co-operating by one of snap-fastening and screw-fastening.

36. An assembly according to claim 17, wherein said wall is a bottom wall.

37. An assembly according to claim 24, wherein the pump communicates with a dip tube of the receptacle.

38. An assembly according to claim 32, wherein a refillable unit comprises a cap suitable for being fastened in a releasable manner by one of screw-fastening and snap-fastening.

39. An assembly according to claim 33, wherein the receptacle contains a perfume.

40. A refillable unit having a longitudinal axis and configured to be disposed in a separable manner on a receptacle, the refillable unit comprising:

a storage chamber for containing liquid and capable of being put into fluid communication with the receptacle to be filled therefrom when the refillable unit is placed on the receptacle; and a pump having a pump chamber that is distinct from the storage chamber and being configured for taking liquid from the receptacle without taking liquid from the storage chamber when the refillable unit is placed thereon, and for taking liquid from the storage chamber when the refillable unit is separate from the receptacle, the refillable unit comprising a body and a piston that is movable relative to the body along the longitudinal axis of the refillable unit and the receptacle, the piston being of annular shape and extending all around a part of the pump.

41. A refillable unit according to claim 40, the unit being configured to enable suction to be generated in the storage chamber, at least when the storage chamber is in fluid communication with the receptacle, so as to enable the storage chamber to be filled under an effect of the generated suction.

42. A refillable unit according to claim 40, wherein a volume of the pump chamber is smaller than a maximum volume of the storage chamber.

43. A refillable unit according to claim 40, wherein the storage chamber has a volume that is substantially constant.

44. A refillable unit according to claim 43, the unit including a first orifice suitable for being put into fluid communication with the pump and the receptacle to enable the pump to take liquid from the receptacle when the refillable unit is placed on the receptacle, and a second orifice distinct from the first orifice, suitable for being put into fluid communication with the receptacle to fill the storage chamber.

45. A refillable unit according to claim 40, the piston cooperating with the body to define a storage chamber of variable volume.

46. A refillable unit according to claim 45, wherein the storage chamber is situated beneath the piston when the refillable unit is observed in a head-up position.

47. A refillable unit configured to be disposed in separable manner on a receptacle, the refillable unit comprising:

a storage chamber for containing liquid and capable of being put into fluid communication with the receptacle in order to be filled therefrom when the refillable unit is placed on the receptacle; and a pump having a pump chamber that is distinct from the storage chamber and being configured for taking liquid from the receptacle without taking liquid from the storage chamber when the refillable unit is placed on the receptacle, and for taking liquid from the storage chamber when the refillable unit is separate from the receptacle, wherein the refillable unit comprises a body and a piston that is movable relative to the body and that co-operates therewith to define a storage chamber of variable volume, the storage chamber is situated beneath the piston when the refillable unit is observed in the head-up position and wherein the pump comprises a duct, the piston being secured around said duct, and wherein the piston includes a bottom face that is set back from a bottom end of the duct, said duct including a portion that extends the duct downward beneath the piston.

* * * * *